United States Patent [19]

Platt

[11] Patent Number: 4,713,919

[45] Date of Patent: Dec. 22, 1987

[54] LASER WELDED CEILING GRID MEMBERS

[75] Inventor: William J. Platt, Collingdale, Pa.

[73] Assignee: National Rolling Mills Inc., Malvern, Pa.

[21] Appl. No.: 904,024

[22] Filed: Sep. 5, 1986

[51] Int. Cl.[4] ..... E04C 3/32; E04C 3/04; B23K 9/00

[52] U.S. Cl. ..... 52/232; 52/729; 52/732; 52/DIG. 5

[58] Field of Search ..... 52/732, DIG. 5, 729, 52/232; 219/121 LD, 121 ED; 228/173.6, 173.7

[56] References Cited

U.S. PATENT DOCUMENTS

| | | | |
|---|---|---|---|
| 3,071,855 | 1/1963 | Mineah | 228/173.7 X |
| 3,158,925 | 12/1964 | Edge | 228/173.7 X |
| 3,517,474 | 6/1970 | Lanternier . | |
| 3,686,819 | 8/1972 | Atkinson . | |
| 3,845,544 | 11/1974 | Nurminen et al. . | |
| 4,023,005 | 5/1977 | Bolin | 219/121 LD |
| 4,128,978 | 12/1978 | Beynon | 52/DIG. 5 |
| 4,246,737 | 1/1981 | Eiloart | 52/729 |
| 4,455,806 | 6/1984 | Rice . | |
| 4,471,204 | 9/1984 | Takafuji et al. | 219/121 LD |
| 4,489,529 | 12/1984 | Ollinger et al. . | |
| 4,554,718 | 11/1985 | Ollinger et al. . | |
| 4,598,514 | 7/1986 | Shirey | 52/DIG. 5 |
| 4,606,166 | 8/1986 | Platt et al. | 52/232 X |

FOREIGN PATENT DOCUMENTS

| | | | |
|---|---|---|---|
| 848115 | 8/1970 | Canada | 52/729 |
| 2459421 | 6/1976 | Fed. Rep. of Germany | 52/729 |

*Primary Examiner*—Alfred C. Perham

*Attorney, Agent, or Firm*—John F. A. Earley; John F. A. Earley, III

[57] ABSTRACT

A method of making an inverted T shaped ceiling grid member comprises the steps of folding a sheet of metal to form a vertical central web with a bulb at the top and having two web sidewalls with a pair of oppositely disposed horizontal flanges extending outwardly from the bottom of the web for supporting ceiling tiles, and laser welding the two web sidewalls together by applying a laser beam thereto to form a laser weld to increase the strength and rigidity of the ceiling grid member. A cap may be attached to the flanges to cover the bottom of the flanges. A metal inverted T shaped ceiling grid member comprises a vertical web having a bulb at the top and having two web sidewalls, a pair of oppositely disposed horizontal flanges extending outwardly from the bottom of the web, and a laser weld joining the two web sidewalls together. A cap may be attached to the flanges to cover the bottom of the flanges.

21 Claims, 5 Drawing Figures

LASER WELDED CEILING GRID MEMBERS

BACKGROUND OF THE INVENTION

1. Field of the Invention

This invention relates to suspended ceiling grid structures, and more particularly concerns metal inverted T shaped suspended ceiling grid members such as main runners and cross tees and to a method of making them.

2. Description of the Prior Art

Prior art suspended ceiling grid members have been formed by bending a sheet of metal, for example, steel, aluminum, or stainless steel, to form a vertical central web with a bulb at the top and having two web sidewalls and a pair of oppositely disposed horizontal flanges extending outwardly from the bottom of the web to support ceiling tiles. Added strength and rigidity have been given to the inverted T shaped grid member by Ollinger and Shaub in U.S. Pat. No. 4,554,718 by coating the inside portions of the web sidewalls with a hot melt adhesive, and in their U.S. Pat. No. 4,489,529 by fastening together the web sidewalls with hot melt adhesive, a welding, or a lancing pattern.

While these prior art methods of strengthening inverted T grid members have their advantages, the addition of adhesive is somewhat messy and adds to the cost, hot arc welding may destroy a portion of any galvanized coating on both surfaces of the sheet which forms the grid member, and punching lance patterns into the web destroys the integrity of the web.

SUMMARY OF THE INVENTION

The present invention provides an inverted T grid member that is strengthened and is made more rigid by forming the grid member and joining the web sidewalls together by laser welding by applying a laser beam to the web sidewalls to fuse the metal together and form a weld. This procedure does not disturb any galvanized coating on the surfaces of the grid member except those portions which are touched directly by the laser beam. A fire-rated embodiment of the invention utilizes an expansion relief section, preferably the one disclosed in U.S. Pat. No. 4,606,166 which is incorporated herein by reference.

DETAILED DESCRIPTION

Figure 2:
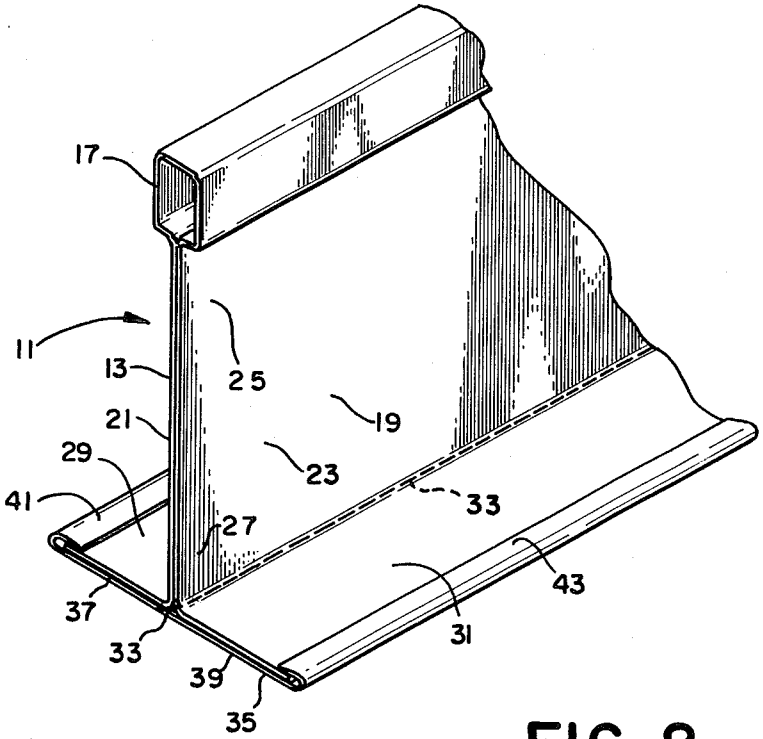
FIG. 2 is a view in perspective of a portion of the main runner of FIG. 1.
Figure 1:
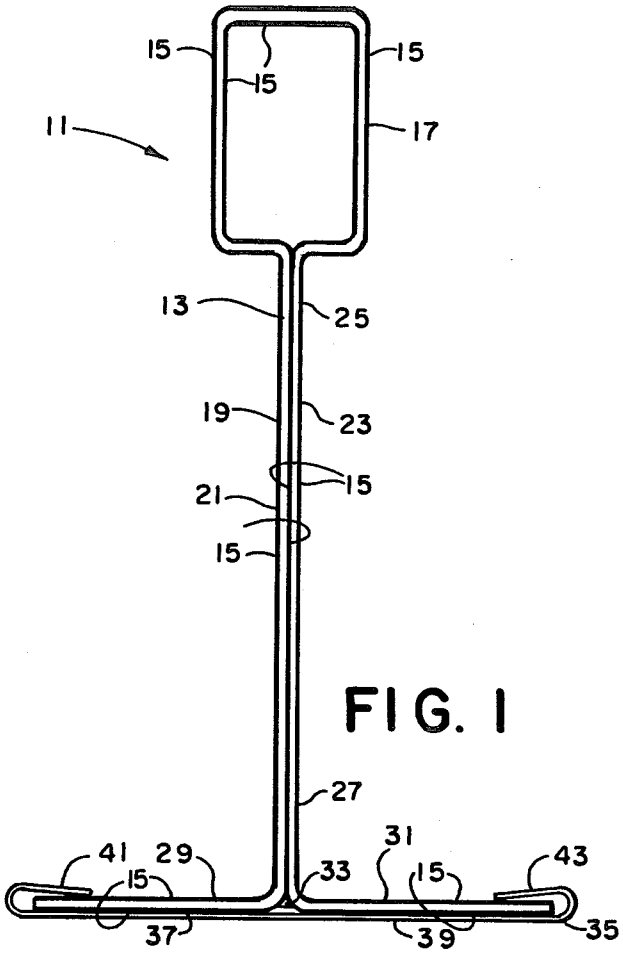
FIG. 1 is an end view in elevation of an inverted T shaped suspended ceiling main runner constructed in accordance with this invention.

Turning now to FIGS. 1 and 2 of the drawings, there is shown a ceiling grid main beam or runner 11 which has an inverted T shape and is adapted to be suspended from a ceiling by wires. Cross tees have the same inverted T shape and are inserted into vertical slots in the web of the runners in order to form a suspended ceiling grid which supports ceiling tiles in a suspended ceiling system.

The method of making the inverted T shaped ceiling grid runner 11, or a cross tee, in accordance with this invention comprises the steps of folding a sheet 13 of metal, which may be aluminum, stainless steel, or mild steel with a galvanized coating 15. The sheet 13 is folded to form an upper bulb or bead 17, which may be of rectangular shape, and to form a vertical central web 19 having two sidewalls 21, 23 with an upper portion 25 and a lower portion 27.

A pair of oppositely disposed horizontal flanges 29, 31 extend outwardly from the bottom of web 19 and are adapted to support ceiling tiles to form the suspended ceiling.

The two web sidewalls 21 and 23 are laser welded together by applying a laser beam to the bottom of the web sidewalls 21 and 23 between the two flanges 29 and 31 to fuse the metal together and form a weld 33. In this welding or fusing operation, the galvanized coating 15 which is not touched by the laser beam remains intact and is not disturbed or destroyed by the laser beam. Only the portion of the galvanized coating 15 which is impinged upon by the laser beam is in any way disturbed by the laser welding operation, and the disturbed area may be coated with paint, if desired, or may be concealed from view by attaching a cap 35 to the flanges 29, 31 to cover the bottom 37 of the flanges.

Cap 35 includes a bottom portion 39 and upper fingers 41, 43 which are rolled over the top of flanges 29, 31 to attach the cap to the flanges.

The metal inverted T shaped ceiling grid member 11 constructed in accordance with this embodiment of the invention comprises a vertical web 19 having two web sidewalls 21, 23 with an upper bulb or bead 17 at the top, a pair of oppositely disposed horizontal flanges 29, 31 extending outwardly from the bottom of web 19 for supporting ceiling tiles, and a laser weld 33 joining the bottom of the two web sidewalls 29, 23 together. The laser weld 33 is preferably located at the bottom portion of the web 19 between the two flanges 29, 23. Cap 35 is attached to the flanges 29, 31 by fingers 41, 43 and the cap covers the bottom of the flanges 29, 31.

In operation, the ceiling grid main beams 11 are assembled together with cross tees having a similar inverted T shape to form a ceiling grid structure which supports ceiling tiles in a suspended ceiling.

Figure 3:
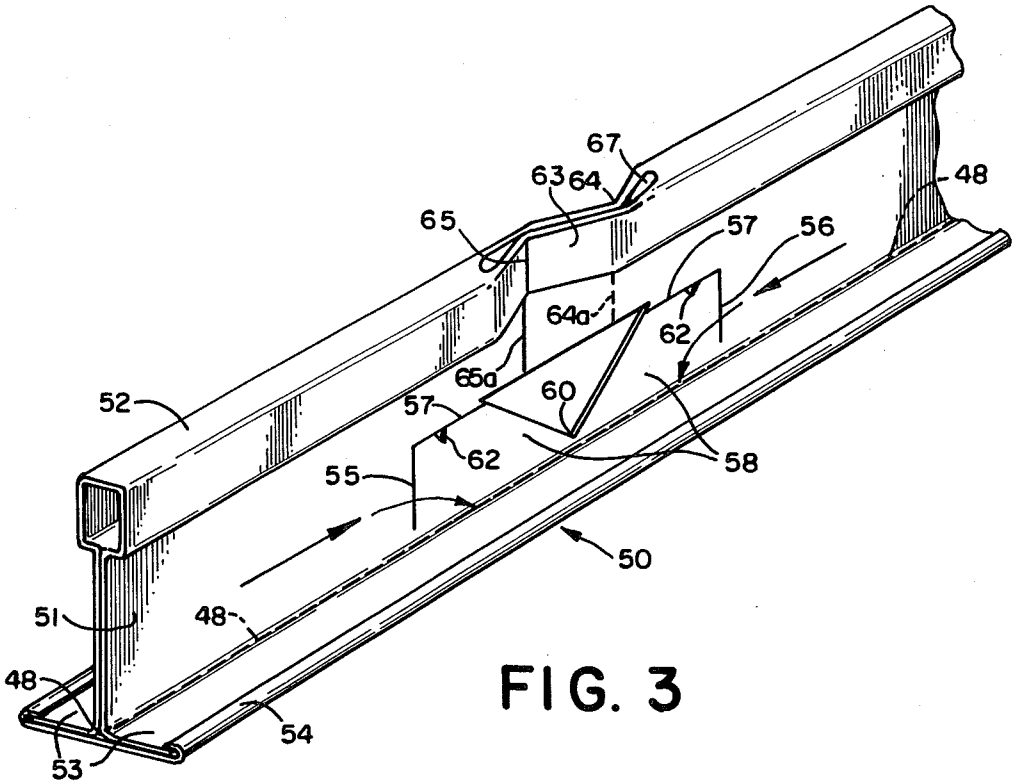
FIG. 3 is a view in perspective of a fire-rated main runner constructed in accordance with this invention.

Referring now to FIG. 3, there is shown a laser weld 48 in a fire-rated beam 50 having an inverted T construction which includes a central web 51 with a bulb 52 at the top and a pair of oppositely disposed flanges 53, 53 at the bottom for supporting ceiling tiles or the like. The fire-rated beam 50 is preferably of double web type in which a strip of sheet metal is bent intermediate its longitudinal edges to form the bulb 52 with the portion of the strip at opposite sides of the bulb being brought into parallel relation to form the web 51 and the edge portions of the strip being bent at right angles thereto to form the oppositely disposed flanges 53, 53. After applying the laser weld 48 to web 51, a separate decorative cap 54 is applied to cover the flanges and is formed by a strip of material having its longitudinal edges folded around the adjacent edges of the associated flanges 53, 53.

The expansion section of the fire-rated beam 50 is substantially defined by two spaced vertical cuts 55, 56 in web 51. The vertical cuts 55, 56 extend upwardly in the web 51 from a location adjacent the flanges 53, 53 and a horizontal cut 57 extends between the upper ends of the vertical cuts 55, 56 to form a tab 58 extending upwardly from the pair of flanges 53, 53. The tab 58 has an inverted triangular cut-out portion with the base thereof extending along the horizontal cut 57 and the apex 60 thereof adjacent the pair of flanges 53, 53 dividing the tab 58 into two portions. A pair of protuberances 62, 62 are formed in the upper edge of the tab 58 and are disposed on opposite sides of the triangular cut-out portion. The protuberances 62, 62 are in abutting relation to the opposed section of the web 51.

In the expansion relief section of the beam a section of the bulb 52 has a crushed portion 63, the center of which is opposite the apex 60 of the triangular cut-out portion. The crushed portion 63 has spaced vertical crush lines or indentations 64 and 65 at the opposite sides and ends thereof which provide lines for bending the bulb 62 and produce a substantially Z-shaped configuration. Web 51 is provided with crush lines or indentations **64*a* and 65*a* which provide lines for bending the web 51** when subjected to the expansion forces caused by the heat of a fire.

The crushed portion of the bulb 52 is provided with a tuck 67 in the top of the bulb. The purpose of the tuck 67 is to insure that the crushed portion 63 of the bulb does not extend above the normal upper surface of the bulb 52 and also to provide additional strength in the bulb 52 at the crushed area.

When the fire-rated beams are mounted in position to support a suspended ceiling, the ends of the beams are in fixed position. When a beam 50 is subjected to expansion forces accompanying fire conditions the Z-shaped configuration of the crushed portion 63 of the bulb 52 is compressed along the axis of the beam 50 creating bending at lines 64 and 65 of the bulb 52, and lines **64*a* and 65*a* of the web 51, thereby moving from the normal position shown in FIG. 3 to the position after expansion of the beam 50**.

The protuberances 62 make the web 51 stronger during normal operation because they provide a path for lines of force to flow from the top of bulb 52 through web 51 to the flanges 53, 53 when beam 50 is in normal operation, not in the presence of a fire and not being subjected to the expansive forces of a fire. Without protuberances 62 the portion of web 51 above horizontal cut 57 may not contact the portion of web 51 below horizontal cut 57, and this would weaken the web. Protuberances 62 strengthen the web 51 during normal use by providing contact between the portions of the web 51 above and below horizontal cut 57.

The two sidewalls of web 51 are laser welded together by applying a laser beam to the bottom of the web 51 between the flanges 53, 53 to fuse the metal together and form a weld 48.

The method of making the beam 50 of FIG. 3 comprises the steps of folding a sheet of metal to form a vertical central web 51 with two web sidewalls and with a bulb 52 at the top and a pair of oppositely disposed horizontal flanges 53, 53 extending outwardly from the bottom of web 51 for supporting ceiling tiles, laser welding the two web sidewalls together by applying a laser beam to the bottom of web 51 between the two flanges 53, 53 to fuse the metal of the sidewalls together to form a laser weld 48, attaching a cap 54 to the flanges 53, 53 to cover the bottom of the flanges 53, 53, and stamping into the web 51 expansion section which is located between the vertical cuts 55, 56.

Figure 5:
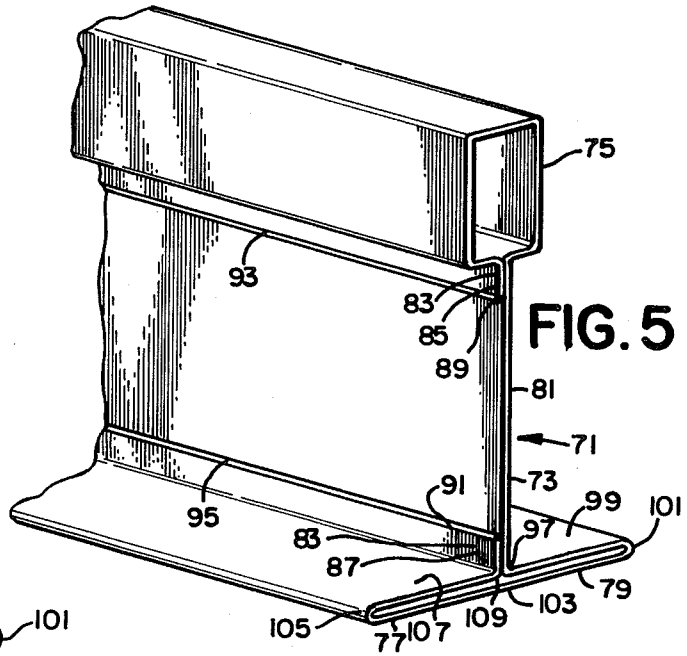
FIG. 5 is a perspective view of the embodiment of FIG. 4 showing the left side of FIG. 4.
Figure 4:
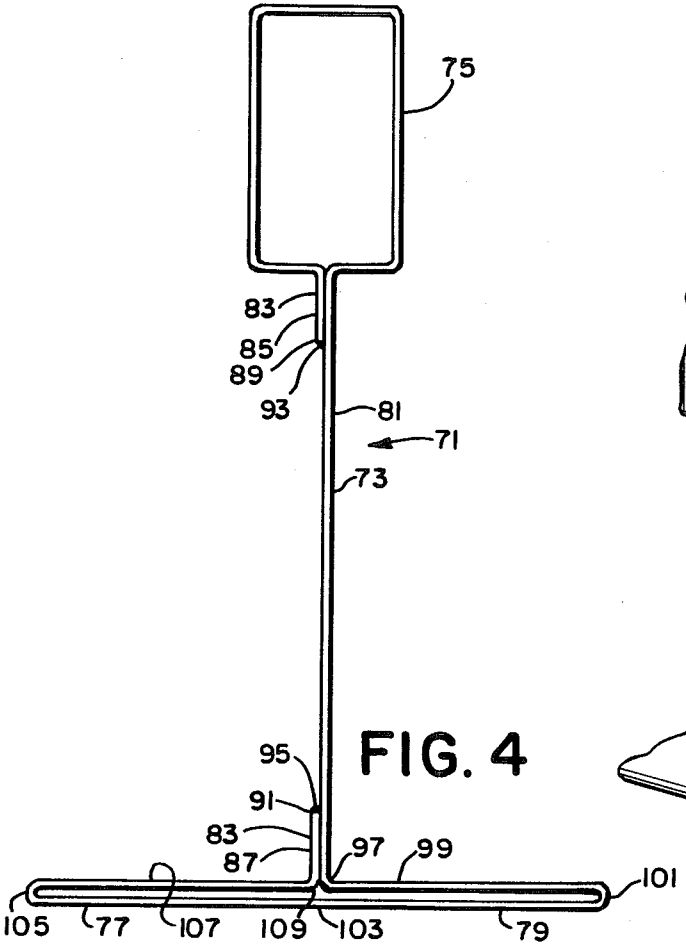
FIG. 4 is an end view in elevation of an inverted T shaped main runner with a first web sidewall extending from top bulb to bottom flanges and a second web sidewall having short upper and lower sidewall portions spaced away from each other.

Turning now to the embodiment of the invention shown in FIGS. 4 and 5, there is shown a ceiling grid member 71, which may be a main beam or a runner or may be a cross tee, adapted to be suspended from a ceiling and to interlock with other grid members to form a suspended ceiling grid system for supporting ceiling tiles in a suspended ceiling.

Ceiling grid member 71 comprises a vertical web 73 having a bulb 75 at the top, and a pair of oppositely disposed horizontal flanges 77, 79 extending outwardly from the bottom of the web 73 for supporting ceiling tiles.

Web 73 is provided with two web sidewalls 81 and 83, with first web sidewall 81 extending from the top bulb 75 to the flanges 77, 79, and second web sidewall 83 comprising a short upper sidewall portion 85 that extends downwardly from the bulb 75 and covers the upper portion of the first web sidewall 81, and a short lower sidewall portion 87 that extends upwardly from the flange 77 and covers the lower portion of the first web sidewall 81, with the short upper sidewall portion 85 having a bottom edge 89 that is spaced away from an upper edge 91 of the short lower sidewall portion 87.

A laser weld 93 joins the short upper sidewall portion 85 of the second web sidewall 83 to the first web sidewall 81 at its upper portion, and a laser weld 95 joins the short lower sidewall portion 87 of the second web 83 to the lower portion of the first web sidewall 81, to increase the strength and rigidity of the ceiling grid member 71.

The method of forming the ceiling grid member 71 comprises the steps of bending a sheet of metal to form a top bulb 75, which may be rectangular, and has extending downwardly therefrom at one side the short upper sidewall portion 85 of second web sidewall 83. The bulb 75 has extending downwardly therefrom at the other side the first web sidewall 81 which is folded at the bottom at bend 97 to form an upper flange portion 99 that flares outwardly and is folded at outer bend 101 to form lower flange face 103 that extends horizontally and is folded at outer bend 105 to form upper flange portion 107 that extends to vertical web 73 where it is folded at bend 109 to form the short lower sidewall portion 87 of second sidewall 83.

A laser beam is applied between the short upper sidewall portion 85 and the first web sidewall 81 to fuse the metal together and to form upper laser weld 93, and a laser beam is applied between the short lower sidewall portion 87 and the first web sidewall 81 to fuse the metal of the sidewalls together and to form the laser weld 95.

ADVANTAGES

One of the advantages of the invention is that it increases the load strength and the rigidity of the ceiling grid member. Alternatively, the ceiling grid member may be made thinner and lighter in weight and still meet ceiling grid performance requirements. This weight reduction lowers trucking costs.

Also, a coil of metal which is being converted to conventional ceiling grid members would normally last for a specific length of time. With the present invention, because of the thinness of the ceiling grid member and the reduction in its weight per unit length, a coil lasts longer, and the number of linear feet of ceiling grid member produced per coil of metal is increased.

Further, there is a certain amount of down time involved in changing coils between the time a coil has been formed into ceiling grid members and the time a new coil is placed in position. This invention reduces the number of coil changes required during the course of a day because the coils are changed less frequently, and the overall down time is decreased.

The ceiling grid member of this invention has improved torque strength and improved vertical as well as horizontal load strength.

I claim:

1. A method of making an inverted T shaped ceiling grid member, comprising folding a sheet of metal to form a vertical central web with a bulb at the top and having two web sidewalls with upper and lower portions and with a pair of oppositely disposed horizontal flanges extending outwardly from the bottom of the web for supporting ceiling tiles, and laser welding two web sidewalls together after the sheet of metal has been folded into a joint by applying a laser beam along the exposed longitudinal portion of the joint formed by the two web sidewalls after the sheet of metal has been folded to form a laser weld to increase the strength and rigidity of the ceiling grid member.

2. The method of claim 1, including applying the laser beam to the bottom of the web between the two flanges to fuse the metal of the web sidewalls together to form a weld.

3. The method of claim 1, including attaching a cap to the flanges to cover the bottom of the flanges.

4. The method of claim 1, including forming a fire expansion relief section in the web to allow for expansion of the grid member during a fire without substantial twisting of the grid member thereby avoiding displacement of the support for the ceiling tiles.

5. The method of claim 4, wherein said expansion relief section comprises a section of said web having a pair of spaced vertical cuts in said web and a horizontal cut extending between said vertical cuts to form a tab extending upwardly from said pair of flanges, said tab having an edge contacting an edge of said cuts for blocking upward movement of the tab to prevent the flanges of the beam from bending upwardly when the beam is subjected to expansion forces, said tab having an inverted triangular cut-out portion with the apex thereof adjacent said pair of flanges and dividing said tab into two portions, and a section of said bulb having a crushed portion opposite said apex of said triangular cut-out portion, said crushed portion of said bulb having a configuration such that when said beam is subjected to expansion forces accompanying fire conditions the configuration of said crushed portion of said bulb is bent at two points along the axis of said beam and said flanges of said beam are bent downwardly adjacent said apex of said triangular cutout portion to relieve the expansion forces without substantial twisting of said beam thereby avoiding displacement of the support for the ceiling tiles.

6. The method of claim 4, wherein said expansion relief section comprises a section of said web having a pair of spaced vertical cuts in said web and a horizontal cut joining said vertical cuts to form a tab portion extending upwardly from said pair of flanges, said tab portion having an inverted triangular cutout portion with the base thereof extending along said horizontal cut and the apex thereof adjacent said pair of flanges, a pair of protuberances formed in the upper edge of said tab and disposed on opposite sides of said triangular cut-out portion, said protuberances contacting the portion of the web above the horizontal cut to provide a path for lines of force to flow from the top of the bulb through the web to the flanges when the beam is in normal operation, and a section of said bulb having a crushed portion opposite said apex of said triangular cut-out portion, said crushed portion of said bulb having a substantially Z-shaped configuration, said crushed portion of said bulb having a tuck in the top thereof so that said crushed portion does not extend above the surface of the adjacent uncrushed portions of said bulb, whereby when said beam is subjected to expansion forces accompanying fire conditions the Z-shaped configuration of said crushed portion of said bulb is compressed along the axis of said beam and said vertical cuts on said tab cooperate with the opposed section of said web to cause said flanges of said beam to bend downwardly, and to prevent said flanges from bending upwardly, adjacent said apex of said triangular cut-out portion to relieve the expansion forces without substantial twisting of said beam thereby avoiding displacement of the support for the ceiling tiles.

7. The method of claim 1, including folding the sheet of metal to form a first web sidewall that extends from the bulb to the flanges, and to form a second web sidewall that comprises a short upper sidewall portion that extends downwardly from the bulb and covers the upper portion of the first web sidewall, and a short lower sidewall portion that extends upwardly from the flanges and covers the lower portion of the first web sidewall, with the short upper sidewall portion having a bottom edge spaced away from an upper edge of the short lower sidewall portion.

8. The method of claim 7, including applying the laser beam to the web between said short upper sidewall portion and the first sidewall to fuse the metal together to form a laser weld, and applying the laser beam to the web between said short lower sidewall portion and the first sidewall to fuse the metal together to form a laser weld.

9. The method of claim 1, including forming a first web sidewall to extend from the top bulb to one of the flanges at the bottom of the web, forming a second web sidewall having short upper and lower sidewall portions spaced away from each other, forming said short upper sidewall portion to extend downwardly from the top bulb, and forming said short lower sidewall portion to extend upwardly from the other one of the flanges, and laser welding the two web sidewalls together by applying a laser beam between the short upper sidewall portion and the first web sidewall, and by applying a laser beam between the short lower sidewall portion and the first web sidewall, to fuse the metal of the sidewalls together.

10. A method of making an inverted T shaped ceiling grid member, comprising folding a sheet of metal to form a vertical central web with a bulb at the top and having at least two web sidewalls with upper and lower portions and with a pair of oppositely disposed horizontal flanges extending outwardly from the bottom of the web for supporting ceiling tiles, laser welding two web sidewalls together by applying a laser beam thereto to increase the strength and rigidity of the ceiling grid member, applying the laser beam to the bottom of the web between the two flanges to fuse the metal of the web sidewalls together to form a weld, and attaching a cap to the flanges to cover the bottom of the flanges.

11. A metal inverted T shaped ceiling grid member, comprising a vertical central web having a bulb at the top and having two web sidewalls with upper and lower portions, a pair of oppositely disposed horizontal flanges extending outwardly from the bottom of the web for supporting ceiling tiles, and a laser weld joining the two web sidewalls together along the exposed longitudinal portion of the joint formed by the two web sidewalls after the grid member has been constructed to increase the strength and rigidity of the ceiling grid member.

12. The ceiling grid member of claim 11, the laser weld being located at the bottom portion of the web between the two flanges.

13. The ceiling grid member of claim 11, including a cap attached to the flanges to cover the bottom of the flanges.

14. The ceiling grid member of claim 11, the laser weld being located at the bottom portion of the web between the two flanges, and a cap attached to the flanges to cover the bottom of the flanges.

15. The ceiling grid member of claim 11, including fire expansion relief means in the web to allow for expansion of the grid member during a fire without substantial twisting of the grid member thereby avoiding displacement of the support for the ceiling tiles.

16. The ceiling grid member of claim 15, said fire expansion relief means including a section of said web having a pair of spaced vertical cuts in said web and a horizontal cut extending between said vertical cuts to form a tab extending upwardly from said pair of flanges, said tab having an edge contacting an edge of said cuts for blocking upward movement of the tab to prevent the flanges of the beam from bending upwardly when the beam is subjected to expansion forces, said tab having an inverted triangular cut-out portion with the apex thereof adjacent said pair of flanges and dividing said tab into two portions, and a section of said bulb having a crushed portion opposite said apex of said triangular cut-out portion, said crushed portion of said bulb having a configuration such that when said beam is subjected to expansion forces accompanying fire conditions the configuration of said crushed portion of said bulb is bent at two points along the axis of said beam and said flanges of said beam are bent downwardly adjacent said apex of said triangular cutout portion to relieve the expansion forces without substantial twisting of said beam thereby avoiding displacement of the support for the ceiling tiles.

17. The ceiling grid member of claim 15, said fire expansion relief means including a section of said web having a pair of spaced vertical cuts in said web and a horizontal cut joining said vertical cuts to form a tab portion extending upwardly from said pair of flanges, said tab portion having an inverted triangular cutout portion with the base thereof extending along said horizontal cut and the apex thereof adjacent said pair of flanges, a pair of protuberances formed in the upper edge of said tab and disposed on opposite sides of said triangular cut-out portion, said protuberances contacting the portion of the web above the horizontal cut to provide a path for lines of force to flow from the top of the bulb through the web to the flanges when the beam is in normal operation, and a section of said bulb having a crushed portion opposite said apex of said triangular cut-out portion, said crushed portion of said bulb having a substantially Z-shaped configuration, said crushed portion of said bulb having a tuck in the top thereof so that said crushed portion does not extend above the surface of the adjacent uncrushed portions of said bulb, whereby when said beam is subjected to expansion forces accompanying fire conditions the Z-shaped configuration of said crushed portion of said bulb is compressed along the axis of said beam and said vertical cuts on said tab cooperate with the opposed section of said web to cause said flanges of said beam to bend downwardly, and to prevent said flanges from bending upwardly, adjacent said apex of said triangular cut-out portion to relieve the expansion forces without substantial twisting of said beam thereby avoiding displacement of the support for the ceiling tiles.

18. The ceiling grid member of claim 11, wherein a first web sidewall extends from the top bulb to the flanges, and a second web sidewall comprises a short upper sidewall portion that extends downwardly from the bulb and covers the upper portion of the first web sidewall, and a short lower sidewall portion that extends upwardly from the flanges and covers the lower portion of the first web sidewall, with the short upper sidewall portion having a bottom edge spaced away from an upper edge of the short lower sidewall portion.

19. The ceiling grid member of claim 18, wherein a laser weld joins said short upper sidewall portion of the second web sidewall to the first web sidewall.

20. The ceiling grid member of claim 18, wherein a laser weld joins said short lower sidewall portion of the second web to the first web sidewall.

21. The ceiling grid member of claim 18, wherein a laser weld joins said short upper sidewall portion of the second web to the first web sidewall, and a laser weld joins said short lower sidewall portion of the second web to the first web sidewall.

* * * * *